United States Patent [19]

Cardas

[11] Patent Number: 4,628,151

[45] Date of Patent: Dec. 9, 1986

[54] MULTI-STRAND CONDUCTOR CABLE HAVING ITS STRANDS SIZED ACCORDING TO THE GOLDEN SECTION

[76] Inventor: George F. Cardas, 1158 N. Columbia, Ontario, Calif. 91764

[21] Appl. No.: 814,727

[22] Filed: Dec. 30, 1985

[51] Int. Cl.[4] ..... H01B 7/00; H01B 11/00

[52] U.S. Cl. ..... 174/114 R; 174/113 R; 174/115

[58] Field of Search ..... 174/113 R, 114 R, 114 S, 174/115 R, 128 R, 130 R; 333/1, 236

[56] References Cited

U.S. PATENT DOCUMENTS 3,413,799 12/1968 Lejeune ..... 174/113 R X 4,538,023 8/1985 Brisson ..... 174/113 R X

*Primary Examiner*—Laramie E. Askin

*Attorney, Agent, or Firm*—Boniard I. Brown

[57] ABSTRACT

Optimum signal/power transmission characteristics are realized in a cable containing a plurality of individually insulated conductors which vary in size one to another wherein the ratio of the size of one conductor to the next larger conductor is about 0.62. Normally, at least three different sizes of conductors will be employed in a cable wherein each size classification differs from the next larger or smaller size classification by the specified ratio. This particular ratio is often called the golden section and is the ratio between the two sizes in which the lesser of the two is to the greater as the greater is to the sum of both.

9 Claims, 1 Drawing Figure

MULTI-STRAND CONDUCTOR CABLE HAVING ITS STRANDS SIZED ACCORDING TO THE GOLDEN SECTION

BACKGROUND OF THE INVENTION

This invention relates to a multi-strand conductor cable used to conduct a single composite signal, wherein the sizes of the individual strands thereof are determined in accordance with a sizing system. The sizing system is based upon the golden section.

The concept of providing for a variety of different sized electrical conductors, each individually insulated from one another within a cable wherein the sizes of the various conductors vary one to another according to a predetermined ratio, is apparently undiscovered in the prior art. The concept of using individually insulated conductors is not new. This type of cable is known in the trade as a Litz cable. In a Litz cable the individual conductors are of uniform size such that the particular uniform size effectively conducts the particular signal of interest in order to optimize its frequency, voltage or current carrying capability as desired.

U.S. Pat. No. 3,413,799 to D. Lejeune for a metallic cable recognizes that significant strength advantages may be realized by employing different sized steel strands according to a predetermined ratio within a larger cable. The use of the such different sized strands improves the fatigue life and failure strength of the cable. These strength and fatigue properties are, of course, wholly unrelated to the concern involved with the present invention; that is, efficiency in conducting electrical signals. In the electrical signal cable area, cables undoubtedly exist in which different sized conductors are contained within the cable. However, there is no predetermined relationship between the sizes of the individual conductive strands within the cable, as there is within the present invention.

The cable disclosed herein contains a plurality of individual conductor strands which are designed to act as a single conductive element, even though each of the individual conductive strands within the cable is individually insulated. This is accomplished by providing for a common input to each conductive strand at one end of the cable and a similar single connection to each of the conductive strands at the output end of the cable. Although the phenomenon is not completely understood, employment of different sized individual conductive strands within the cable according to the predetermined golden section ratio produces significantly improved efficiency in the transmission of signals from one end of the cable to another when compared against prior art cables which do not employ this system.

SUMMARY OF THE INVENTION

The multi-strand conductor cable sizing system of this invention is employed to construct a cable which contains at least three different sizes of individual conductive strands, each of which is individually insulated from the other conductive strands within the cable. The size of each class of conductive strands varies to the next larger size class as the next larger size class varies to the sum of the sizes of both. In other words, this ratio of the size of the strand to the size of the next larger strand in a numeric sense is about 0.62. The reference to size will normally refer to the cross sectional area of the individual conductive strands within the cable, although it can also refer to the diameter of the individual conductive strands. The cable with its multiple individual strands is employed as a single conductor. A signal is addressed simultaneously to all of the individual conductors at the input end of the cable, and the signal is extracted from all of the individual conductors at the output end of the cable. By some mechanism which is not completely understood at this time, the signal appears to choose the path of least resistance, as it were, in selecting the class of individual cable sizes which is optimal for the transmission of that particular signal in terms of its frequency, voltage and/or current. Insulation of the individual conductive strands ensures that the signal will remain within the most efficient size of cable until it is delivered to the output end of the cable. Since only some of the multiplicity of individual conductive strands within the cable will be utilized by the signal in this preferential manner, it is intended that more than one of these cables be employed if the signal strength is such that putting all of the signal power into a single cable would tend to override this preferential selection effect and cause the too powerful signal to overflow into individual cable sizes which are not optimal for the transmission of that signal within a single cable. In other words, in order to retain the preferential selection effect, the signal strength within an individual cable should be maintained at an effective level such that the signal is not forced to jump to inefficient-sized conductive strands within the cable. In general terms, the aggregate area of the strands of a single diameter group should be at least 1,000 circular mils per amp in any given frequency range in order to avoid overload.

DETAILED DESCRIPTION OF THE INVENTION

Figure 1:
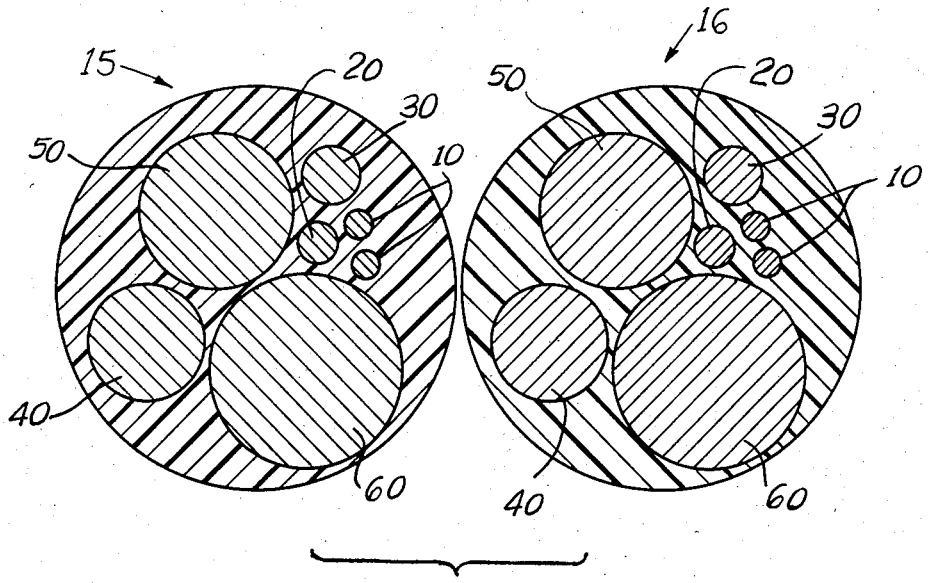
FIG. 1 is a cross-sectional view of two cables, each containing individual conductive strands according to the sizing system of this invention.

The strands of the multi-strand cable are provided in ratios of strand sizes which provide optimum transmission over a variety of frequencies and currents which vary in amplitude or frequency and are particularly capable of handling signals having a wide range of these characteristics. The system provides for extremely good phase response and a high signal to noise ratio when compared against multi-strand cables which do not employ the particular sizing ratio provided herein. The invention has particular application in those usages which require, by definition, broad-band alternating current transmission capabilities. It is especially effective in audio cables including microphones, speaker wires, patch cords, and the like as well as in video signal cables.

The ratios between the sizes of the individual strands within the individual cable are determined in accordance with the "golden section" or "golden mean" ratio. This ratio is the ratio between one class diameter and the next class diameter in which the lesser of the two is to the greater as the greater is to the sum of both, or approximately 0.618. The closer this ratio is approached in the design of the various strand sizes, the better the performance. A typical progression according to this ratio is 1, 1, 2, 3, 5, 8, 13, 21, 34, 55, 89, 144, 233, 377, 610, 987, 1597.

The following table provides general guidance for the recommended cross sectional areas of individual strands for given frequency ranges. The cross sectional area is given as the circular mil area. The circular mil area (CMA) is the normal unit of area in measurement of wire. A circular mil is the area of a circle one mil in diameter. To determine the circular mil area of a round wire, the diameter of the bare wire conductor is squared. As an example, a wire measuring 0.020 inches in diameter (20 mils) has a circular mil area of 400.

| FREQUENCY | CIRCULAR MIL |
|---|---|
| 1 kc to 10 kc | 100 |
| 10 kc to 50 kc | 50 |
| 50 kc to 100 kc | 25 |
| 100 kc to 200 kc | 13 |
| 200 kc to 400 kc | 9 |
| 400 kc to 800 kc | 6 |
| 800 kc to 1.6 mc | 4 |
| 1.6 mc to 3.2 mc | 2.5 |
| 3.2 mc to 5.0 mc | 1.4 |

As was mentioned before, the individual strands of wire are preferentially suited to carry certain frequency ranges based upon the relationship of the cross sectional area of a wire to the particular wave form of interest. Generally, smaller wires preferentially carry higher frequencies and smaller amplitude changes. The above table is an approximation based on line level sine wave data. Different wave forms cause large change levels in the current level, the presence of multiple wave forms in a common conductor, temperature changes, and other effects may all act to skew these ranges somewhat. An individual strand performs best when operating at about 60% to 80% capacity. Higher loading causes heating of the conductor, reactants, noise and compression of the signal. Lower loading levels cause phase distortion, veiling, and loss of definition in the signal. The natural tendency of the signal is for the current to follow the path of least capacitance reactance, all other factors being equal, and the increased reactance of the strands as they approach their individual current carrying capacity appears to be the mechanism that balances the current flow between the appropriate strands.

It should be emphasized again that a primary object of this invention is to define the optimum ratio of strand size progression. The number of strands of any given size within the conductor cable should be adjusted to suit the current requirements in the range to which the strand applies. It is recommended that the smallest strand sizes used be doubled in number relative to the larger sizes, because the initial rise in any wave form will be carried by those strands. In this golden section stranding method, a means has been developed in providing for a nearly perfectly balanced wide range conductor. In this system, the highest frequency served by the cable is selected by a user, thus determining the smallest strand in the cable by traditional methods such as reference to the above disclose table. In this manner, a strand of one circular mil area would be selected for a cable with a high frequency limit of about 5 mc. The size of each additional strand added to the cable will be determined by adding the area of the present strand to the area of the next smaller strand. This sum should be approximately the area of the next larger strand size to be added to the cable. The size of the strands should be increased until the individual strand size capable of handling the lowest frequency in the desired range is included in the progression. In this manner, for a cable whose intended frequency range would be from 800 kc to 5 mc, strands sizes of 1, 2, 3 and 5 circular mil areas should be used. As a practical matter, the areas of commonly available strands of wire will not correlate exactly to this progression. Of course, the practitioner should utilize those standard sizes which most closely approach the appropriate proper diameter from the golden section progression. For this example, the corresponding gages would be 50 AWG (1.0 cma), 47 AWG (1.96 cma), 45 AWG (3.24 cma), and 43 AWG (4.84 cma). This provides the range of diameters of the individual cable classes within the cable. The number of strands in any given size would then be adjusted to the amperage requirements in the various frequency ranges for each wire. Again, as a general rule audio cable handling signals from about 20 Hz to about 20 kHz would use strands in the 80–4,000 CMA range, depending upon the application. Video cable would be adjusted appropriately to include the higher frequency signals present in these wave trains.

Referring now to the drawing FIGURE, two cables are shown, each of which contains six different size classes of individual conductive strands. In each, two individual conductive strands 10 of the smallest diameter are present. Only one of each of the succeedingly larger diameter size classes are found in each of the cables 15 and 16, although more could be present in each cable, as needed. The next larger size beyond the smallest 10 is marked as 20, with the next marked as 30, the next marked as 40, the next marked as 50, and the largest marked as 60. The diameter of each of these size classes varies as against the next larger or smaller as specified by the golden section ratio. The cross sections of each of these individual construction strands within the cables 15 and 16 is meant to indicate the actual cross section of the conductive material, be it copper or aluminum or another metallic substance which is an efficient conductor of electricity. It should be noted that none of the conductors touches another, since each conductive strand is to be insulated from all of the others within the body of the cable. This insulation surrounding the individual conductive strands within the cables 15 and 16 may be any of the many well-known polymeric materials utilized for their electrically insulating properties. The smaller sized strands, because of their low capacitance and other characteristics, transmit small currents and high frequencies efficiently. Therefore, these types of signals will preferentially be transmitted along these smaller conductive strands. Conversely, the lower frequencies and higher currents will tend to flow into the larger diameter conductors. Audio and video signals in particular are a mixture of a number of varying frequencies and signal strengths, and, as such, will be very efficiently transmitted along cables which employ the system of this invention.

As mentioned previously, the physical arrangement of the strands in the cable should not be limited to the embodiments illustrated in the drawing FIGURE since multiples of each size of strand should be utilized for the particular signal as warranted. In other words, if a particular frequency and signal strength level is recognized as being predominating within a particular signal, it may be useful to employ a relatively greater number of a particular size classification of individual conductor strands in order to more efficiently conduct this particular signal component within the cable. When the practical limits of an individual cable are reached, multiple sets of cables can be used in parallel or wound into a common planetary set in order that the preferential selection effect is maintained. For most applications, it has been found that an equal number of each of the different sizes of strands within the cable will give good performance across a large frequency and power spectrum.

It should be understood that the embodiments of the invention described above are illustrative in nature and that the invention is limited only as defined in the following claims.

I claim:

1. A multi-strand conductor cable comprising a plurality of individual conductors insulated from one another wherein the plurality of conductors is characterized by having at least one conductor of each of at least three different diameters wherein the ratio of one diameter to the next larger diameter is approximately as the ratio of the next larger diameter is to the sum of the one diameter and the next larger diameter.

2. The cable of claim 1 wherein each diameter conductor preferentially carries signals in a given range of frequencies such that the number of conductors of each diameter is such that all of the number of conductors operate at less than about 80% of their maximum effective current carrying capacity for the given frequency range.

3. The cable of claim 1 wherein the number of conductors of the smallest diameter is at least about twice the number of conductors of the largest diameter.

4. A multi-strand conductor cable comprising individual conductors insulated from one another wherein the plurality of conductors is characterized by having at least one conductor of each of at least three different diameters wherein the ratio of one diameter to the next larger diameter is about 0.62.

5. The cable of claim 4 wherein each diameter conductor preferentially carries signals in a given range of frequencies such that the number of conductors of each diameter is such that all of the number of conductors operate at less than about 80% of their maximum effective current carrying capacity for the given frequency range.

6. The cable of claim 4 wherein the number of conductors of the smallest diameter is at least about twice the number of conductors of the largest diameter.

7. A multi-strand conductor cable comprising individual conductors insulated from one another wherein the plurality of conductors is characterized by having at least one conductor of each of at least three different cross-sectional areas wherein the ratio of one cross-sectional area to the next larger cross-sectional area is about 0.62.

8. The cable of claim 7 wherein each cross-sectional area conductor preferentially carries signals in a given range of frequencies such that the number of conductors of each cross-sectional area is such that all of the number of conductors operate at less than about 80% of their maximum effective current carrying capacity for the given frequency range.

9. The cable of claim 7 wherein the number of conductors of the smallest cross-sectional area is at least about twice the number of conductors of the largest cross-sectional area.

* * * * *